US005345696A

United States Patent [19]

Bosoni

[11] Patent Number: 5,345,696

[45] Date of Patent: Sep. 13, 1994

[54] DEVICE FOR HOT-AIR DRYING OF A FILM PRINTED IN A ROTOGRAVURE MACHINE

[75] Inventor: Giannino Bosoni, Piacenzą, Italy

[73] Assignee: Schiavi Cesare Costruzioni Meccanichi S.p.A., Milan, Italy

[21] Appl. No.: 960,919

[22] Filed: Oct. 14, 1992

[30] Foreign Application Priority Data

Oct. 18, 1991 [IT] Italy ..... PR91A000048

[51] Int. Cl.[5] ..... F26B 13/00

[52] U.S. Cl. ..... 34/638; 34/639; 34/653; 34/655; 34/620

[58] Field of Search ..... 34/155, 156, 160, 162, 34/23, 24

[56] References Cited

U.S. PATENT DOCUMENTS

| | | | |
|---|---|---|---|
| 2,226,319 | 12/1940 | Offen | 34/24 |
| 2,791,039 | 5/1957 | Rosenbaum | 34/160 |
| 3,073,039 | 1/1963 | Williams | 34/231 |
| 3,147,090 | 9/1964 | Russell et al. | 34/160 |
| 3,579,853 | 5/1971 | Martino | 34/160 |
| 3,660,911 | 5/1972 | Buckingham | 34/160 |
| 4,125,948 | 11/1978 | Hering, Jr. et al. | 34/160 |
| 4,135,312 | 1/1979 | Hope et al. | 34/160 |
| 4,693,014 | 9/1987 | Caflisch et al. | 34/160 |
| 4,793,074 | 12/1988 | Jessop et al. | 34/160 |
| 5,079,853 | 1/1992 | Kurokawa | 34/155 |

FOREIGN PATENT DOCUMENTS 0103876 3/1984 European Pat. Off. .

*Primary Examiner*—Denise Gromada
*Attorney, Agent, or Firm*—Hoffmann & Baron

[57] ABSTRACT

A device (1) for the hot-air drying of a printed film in a rotogravure machine, comprising a support structure (3) to house a blowing group (4) which blowing group (4) will feed hot air towards a film (2) to be dried, a plurality of pinions (5) mutually distanced and arranged along a predetermined course, aimed at favoring the introduction of the film (2), a plurality of idler running and supporting rollers (6), mutually distanced and arranged along a predetermined course, to support the film (2) and cause it to run. The said blowing group (4) is fixed and exhibits two lateral uprights (8) into which hot air is introduced, which air flows from above downwards in a plurality of blowing elements (9), mutually-distanced at a good hand's-width from each other.

9 Claims, 3 Drawing Sheets

DEVICE FOR HOT-AIR DRYING OF A FILM PRINTED IN A ROTOGRAVURE MACHINE

BACKGROUND OF THE INVENTION

The invention relates to a device for hot-air drying of a film printed in a rotogravure machine. As is well-known, a film emerging from a printing operation is wet with ink on its surface and therefore must be dried.

The prior art includes devices with this aim comprising a support frame which supports a single "chest" housing a blowing group composed of a plurality of slits envisaged for the feeding of hot air towards the film to be dried. In the frame there are also: a plurality of rollers mutually distanced one from the next and arranged along a predetermined course so as to favour introduction of the film, a plurality of idle running and support rollers, distanced one from the next and arranged along the said course to support the film and cause it to run, and movement means to draw the film.

Sometimes, because of defective film or excessive tension on the film during the passage through the rollers, the film itself breaks.

When this happens, the free portion, during the successive drawing phase, oscillates while moving and touches both the idler support and running rollers and other components of the blowing group, dirtying them with ink.

Consequently, the necessity arises of stopping the drying operation of the film both to clean the said dirtied components so that no following portion of the film is dirtied, and for the operation of reintroducing the film itself.

For the execution of this cleaning and/or introduction operation of the film, the prior art teaches the opening of the support structure and the translation of the entire blowing group by means of guides, or the rotation of all the group itself about a superiorly-positioned horizontal rotation axis.

In prior art machines the possibility does not exist of gaining access to the rollers and to the various ink-dirtied components in order to clean them, without performing the above-mentioned sliding or rotation operations.

Naturally, in order to effect the movement of the blowing group it is necessary to have a certain amount of space available, which brings about an arrangement of the different printing units with blowing groups which are used in the making of colour films.

Apart from the problems of the machine due to its size, the said sliding or rotation manoeuvre has been found to be difficult due to the fact that the support structure and the blowing group can have a combined weight of up to 12 quintals (about 2645 lbs.). For this reason, a support frame and movement organs have to be of adequate strength and power.

A principal aim of the present invention is substantially to resolve the prior art problems, overcoming the above-described difficulties by means of a device for the hot-air drying of film printed in a rotogravure machine.

A further aim of the present invention is to provide a device for the drying of a printed film which is simple to realize, functionally simple and compatible with the usual machines for such applications.

A still further aim of the present invention is to provide a device which is fixed and does not require the presence of support frames and movement organs to effect the cleaning of the components which perform the drying and drawing of the film.

SUMMARY OF THE INVENTION

These aims and others besides, which will better emerge during the course of the following description, are substantially attained by a device for the hot-air drying of a printed film in a rotogravure machine, comprising:

- a support structure to house a blowing group which blowing group will feed hot air towards a film to be dried;
- a plurality of pinions mutually distanced and arranged along a predetermined course, aimed at favouring the introduction of the film;
- a plurality of idler running and supporting rollers, mutually distanced and arranged along a predetermined course, to support the film and cause it to run;

characterised by the fact that the said blowing group is fixed and exhibits two lateral uprights into which hot air is introduced, which air flows from above downwards in a plurality of blowing elements, mutually-distanced at a good hand's-width from each other.

BRIEF DESCRIPTION OF THE DRAWINGS

Further advantages and characteristics of the present invention will better emerge from the detailed description that follows, made with reference to the accompanying drawings, which represent a preferred embodiment here illustrated in the form of a non-limiting example, and in which.

DESCRIPTION OF THE PREFERRED EMBODIMENTS

Figure 1:
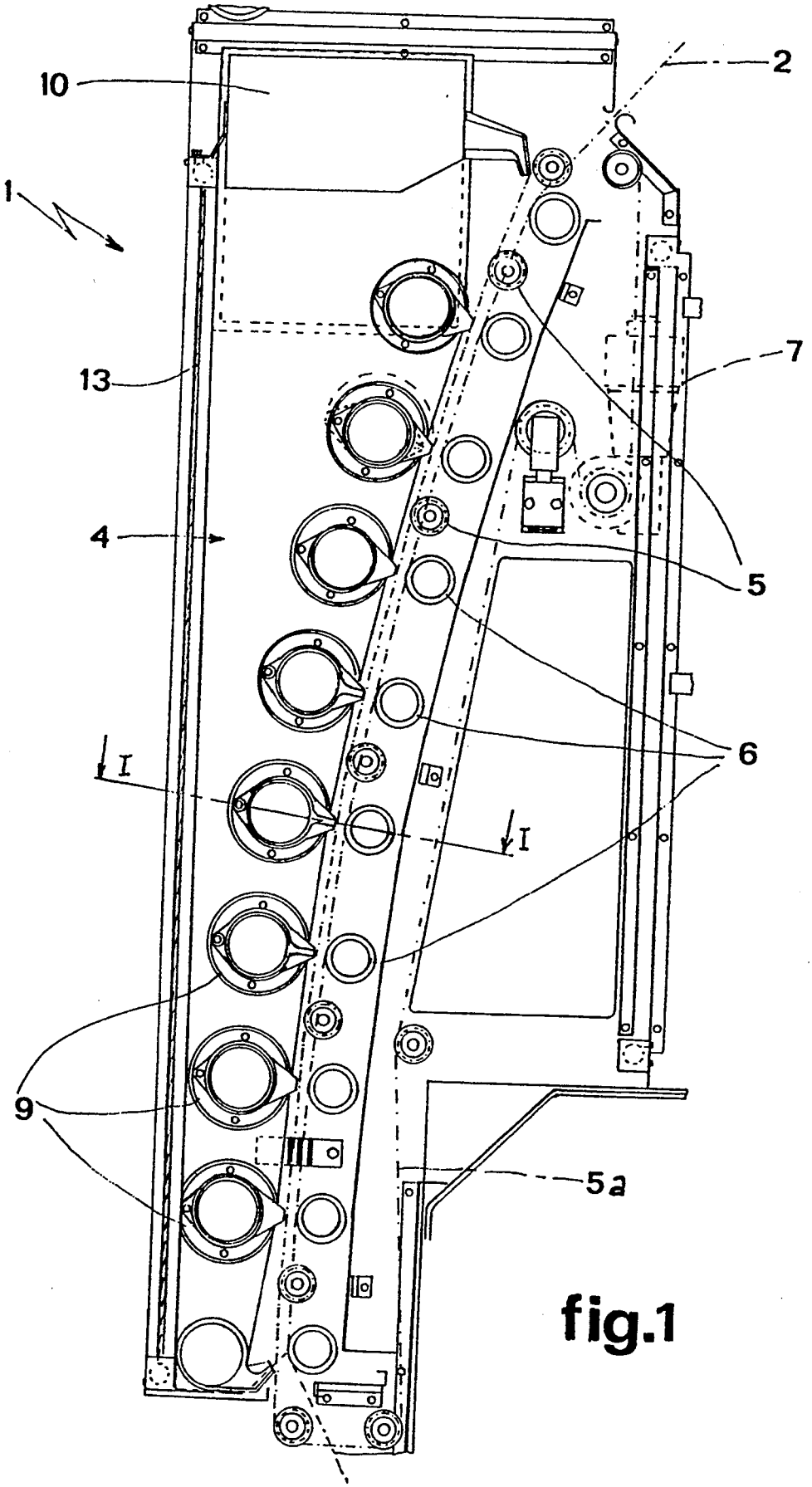
FIG. 1 shows a schematic view of a section of the device for hot-air drying of a printed film in a rotogravure machine, according to the present invention.
Figure 2:
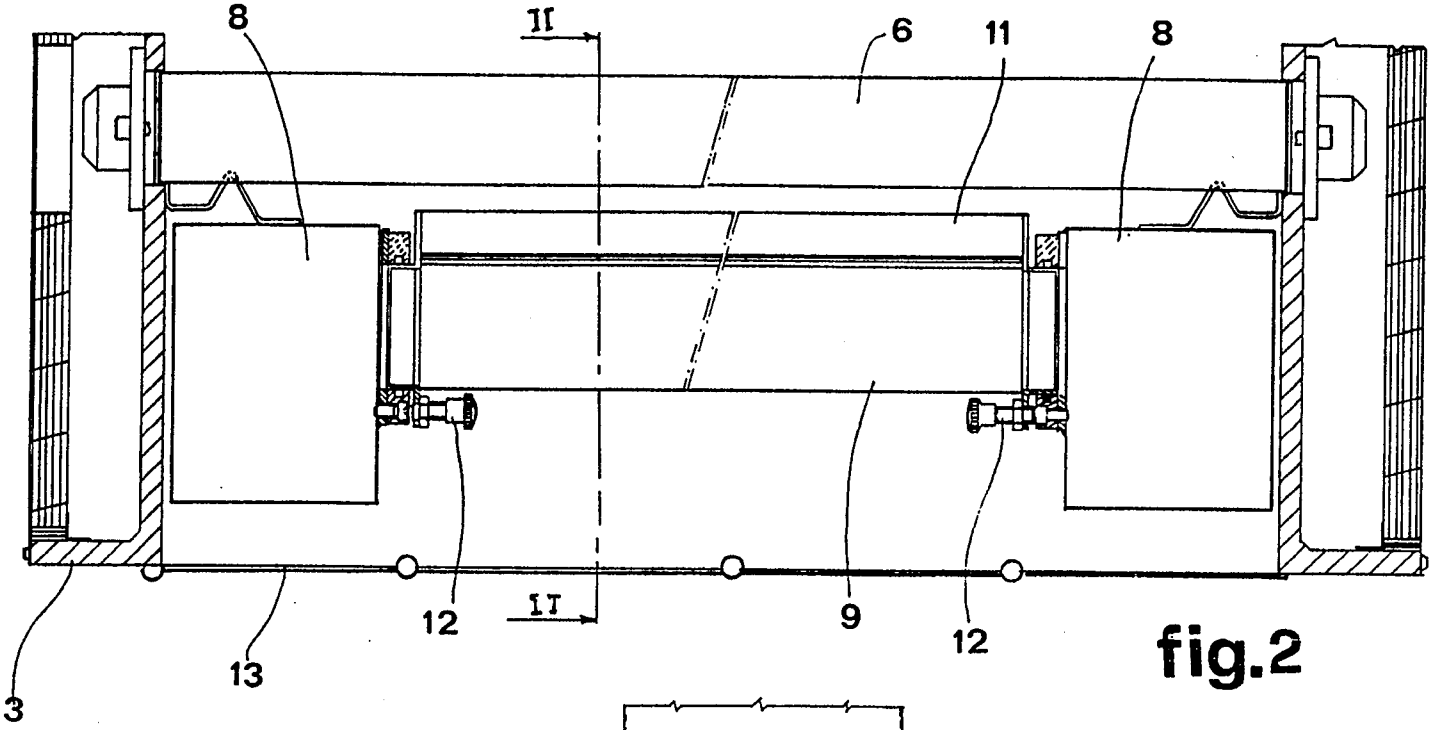
FIG. 2 is a transversal section of the device according to line I—I of FIG. 1.

With reference to the figures, and in particular to FIG. 1, 1 denotes a device for the hot-air drying of a printed film in a rotogravure machine. The device 1 is equipped with a plurality of pinions 5 mutually distanced among themselves and arranged along a predetermined course, and a plurality of idler rollers 6 for the running and support of the film, also mutually distanced along a predetermined course, clearly visible in FIG. 1. In particular, the pinions 5 accompany a belt 5*a* in order to effect the introduction of the film, while the idler rollers 6 support the film 2 and favour its running. Furthermore, the idler rollers 6 are supported to the support structure 3 (FIG. 2).

The belt 5*a* is motorised during the introduction of the film by movement means 7 of substantially known and conventional type.

According to the present embodiment, the blowing group 4 is fixed and exhibits two lateral uprights 8 into which hot air is introduced and flows downwards from above in a plurality of blowing elements 9 reciprocally distanced at a good hand's breadth one from the other.

The lateral uprights 8 are arranged laterally to the blowing elements 9 and are connected to each other by a manifold 10 arranged superiorly, which permits the passage of the air from one uprights 8 is in communication with a device for providing hot air. Furthermore, each upright 8 is constituted by a chest of quadrangular section, into which the air flows.

According to the present embodiment, each of the blowing elements 9 is constituted by a pipe rotatably constrained to the upright 8 and equipped with a projecting portion 11 having a slit for the exit of the hot air.

Furthermore, each blowing element 9 is located in correspondence to an idler roller 6 and exhibits its projecting portion 11 or more precisely the slit of the projecting portion 11 facing the idler roller 6 in such a way that, when the hot air exits, the film 2 is not subjected to tension but rests on the idler roller 6.

The slit-portion 11 is predisposed to be moved from an operative position, wherein the projecting portion 11 is at the position corresponding to the idler roller 6 and emits hot air, to a cleaning position wherein the projecting portion 11 is turned to a predetermined angle to enable the user to eliminate ink present on the blowing element 9 itself.

The group of blowing elements 9 is closed, in the embodiment illustrated in FIGS. 1 and 2, by a folding-door 13.

Figure 4:
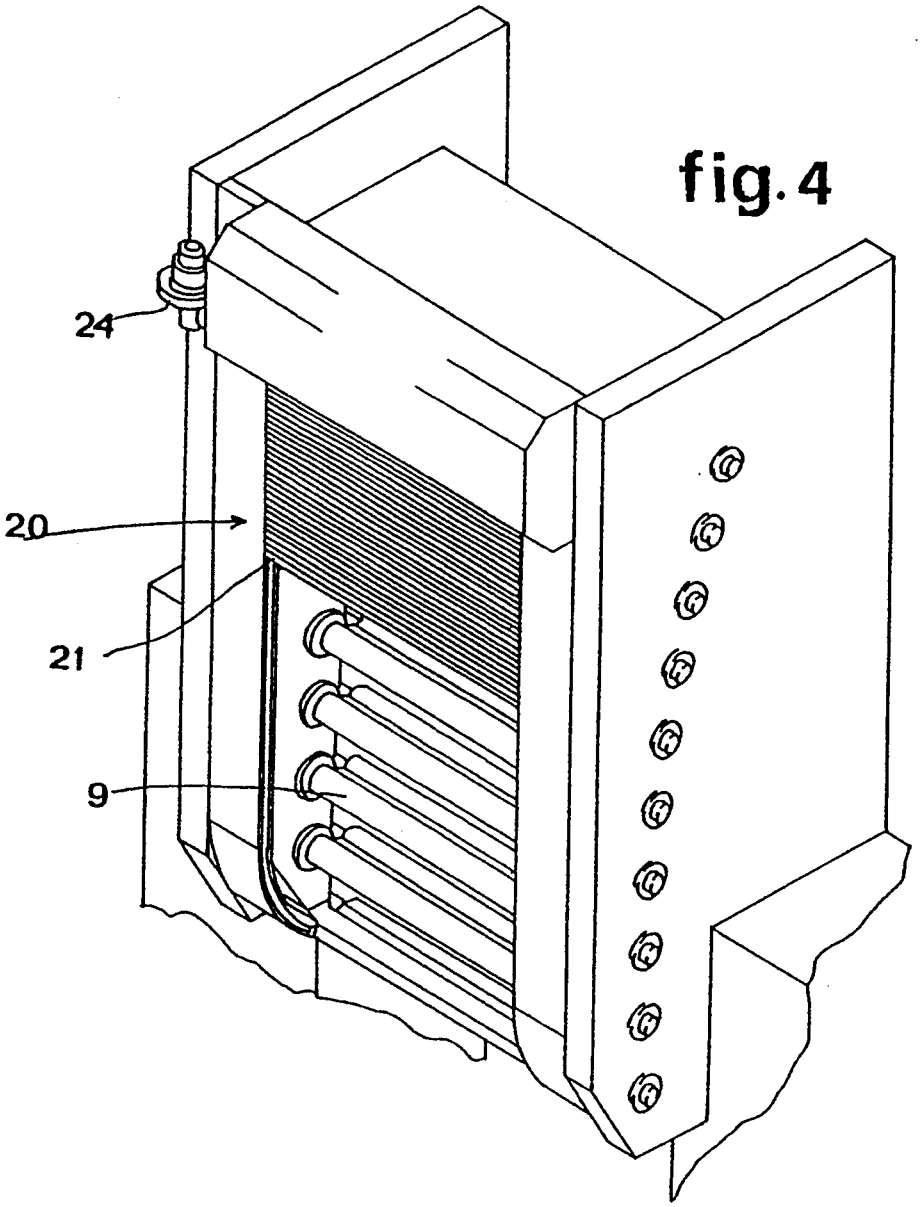
FIG. 4 shows, in perspective view, the device for the hot-air drying of a printed film in a rotogravure machine, according to a further embodiment of the closure.
Figure 5:
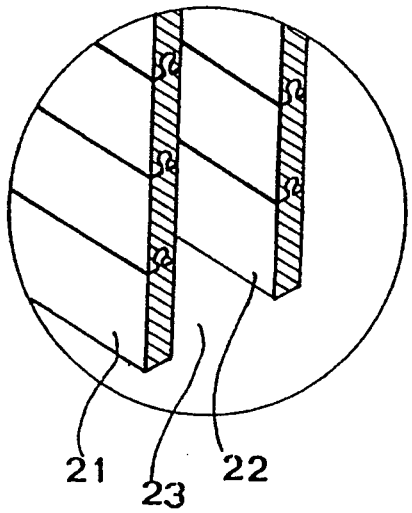
FIG. 5 shows a particular of the closure of the device according to the embodiment of FIG. 4.

It may be advantageous to close the group of blowing elements 9 using a special roller shutter, as is illustrated in FIGS. 4 and 5. A said roller shutter, indicated in its entirety by 20, envisages a pair of shutters, respectively 21 and 22, which are arranged parallel to each other and which internally define a free space 23 which creates an updraft effect that keeps the external shutter 21 cool. Each of the shutters is wound, for the opening and shutting operations, on an upper roller, not illustrated, motorised by a geared motor 24.

The above-described embodiment of the closure 20 presents, apart from the advantage of limited dimensions, especially in open position, the considerable advantage of constituting in closed position a thermally insulated wall to limit the danger of an operator's touching against the device's hot walls.

Figure 3:
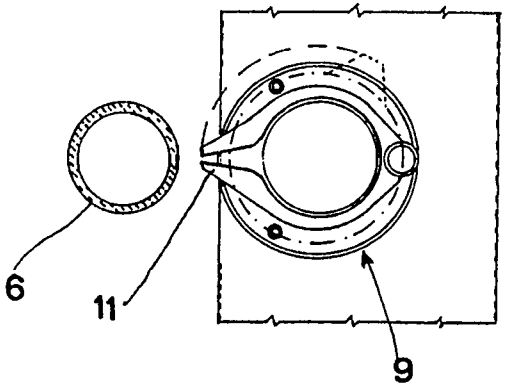
FIG. 3 shows the device in section, according to line II—II of FIG. 2.

The rotation angle of the projecting portion 11 is about 120 degrees, as can be seen from FIG. 3 (broken line).

To permit the passage of the projecting portion 11 from the operative position to the cleaning position, a pawl 12 is envisaged. The pawl 12 keeps the projecting portion 11 in the operative position up until when the position has to be changed.

Since the aforegoing has been principally descriptive, the functioning of the invention will now be explained.

The film to be dried is introduced into the device through an opening. During the passage of the film along the predetermined course inside the device, the film is struck by a mass of hot air emitted by the blowing elements 9 through the slitted projecting portion 11. At the end of the course, the dry film exits through an exit opening.

When the film breaks and dirties the various components of the device with ink, the said components being the idler rollers 6, the blowing elements 9 and in particular the projecting portion 11, it is enough to stop the passage of the film and clean the various components. This operation is performed simply by opening the folding-door 13 or the shutter-type closure 20 and putting a hand into the space between two blowing elements 9 and cleaning up the ink with a cloth. For the easier cleaning of the slitted projecting portion 11, it is sufficient to act on the pawl 12, unhooking it from its locked position. In this way the slitted projecting portion 11 is freed and can be rotated up until it reaches the cleaning position, wherein the ink can be comfortably removed. Once tis operation is finished, the slitted projecting portion 11 can be brought back into the operative position with its slit corresponding to the idler roller 6, the pawl 12 automatically re-adjusting itself.

The present invention thus reaches the proposed aims.

By exhibiting a fixed structure, the device succeeds in considerably reducing its dimensions. As there are not any slidings or rotations of the blowing group 9, less space is needed for its installation between one printing element and the next. In this way it becomes possible to arrange, rationally and efficiently, several blowing groups. Also sliding or rotating means and special support structures are no longer necessary, as they are inthe prior art devices.

Furthermore, the device is less expensive, more functional and simple to build with respect to the devices in the prior art.

It has also been noted that the cleaning operation of the various components is simple since it is possible to reach the blowing elements thanks to the existence of the space between the said elements which allows the passage of a hand and the possibility of rotating the slitted projecting portion 11.

What is claimed:

1. A device for hot-air drying of a film printed in a rotogravure machine, comprising:

a blowing element group including a plurality of spaced apart blowing elements;

a support structure to house the blowing element group, the blowing element group being provided to feed hot air towards a film to be dried;

a plurality of pinions mutually distanced and arranged along a predetermined course, the plurality of pinions being positioned to accommodate the introduction of the film; and a plurality of idler running and supporting rollers mutually distanced and arranged along a predetermined course to support the film and propel the film along the course;

wherein the blowing element group is fixed and further includes two lateral uprights positioned at opposite ends of the plurality of blowing elements into which hot air is introduced, which hot air flows from above downwards towards the film in the plurality of blowing elements, each of the blowing elements of the plurality of blowing elements being mutually-distanced from each other a distance sufficient to permit the passage of a hand.

2. A device as in claim 1, characterised by the fact that each of the lateral uprights is constituted by a chest of quadrangular section into which the hot air flows.

3. A device as in claim 2, which further includes a manifold, the two uprights being mutually connected by the manifold which is arranged to provide hot air communication between the two uprights positioned at opposite ends of the plurality of blowing elements.

4. A device as in claim 1, wherein each of the blowing elements of the plurality of blowing elements includes a pipe rotatably constrained to each upright and further includes a slitted projecting portion to provide for the exit of the hot air.

5. A device as in claim 1, wherein each of the blowing elements of the plurality of blowing elements includes a slitted projecting portion and is located in a position corresponding to an idler roller for the running of the film, and wherein each blowing element of the plurality of blowing elements is positioned to direct hot air on to the film through the slitted projecting portion of each blowing element.

6. A device for hot-air drying of a film printed in a rotogravure machine, comprising:

a blowing element group for feeding hot air towards a film to be dried, the blowing element group including a plurality of spaced apart blowing elements, each blowing element of the plurality of blowing elements including a slitted projecting portion for the exit of hot air;

a support structure to house the blowing element group;

a plurality of pinions mutually distanced and arranged along a predetermined course, the plurality of pinions being positioned to accommodate the introduction of a film to be dried; and a plurality of idler running and supporting rollers mutually distanced and arranged along a predetermined course to support the film and propel the film along the course;

wherein the blowing element group is fixed and includes two lateral uprights positioned at opposite ends of the plurality of blowing elements into which hot air is introduced, which hot air flows from above downwards towards the film in the plurality of blowing elements, each of the blowing elements of the plurality of blowing elements being mutually-distanced from each other a distance sufficient to permit passage of a hand; and wherein the slitted projecting portion of each of the blowing elements is rotatable from an operative position wherein the projecting portion is in a position which corresponds to an idler roller and emits hot air, to a cleaning position wherein the projecting portion is rotated to a predetermined angle to allow an operator to eliminate ink present on each blowing element.

7. A device as in claim 6, characterized by the fact that the angle about which the projecting portion is rotatable is about 120 degrees.

8. A device as in claim 6, characterized by the fact that the projecting portion is constrained in the operative position by a pawl.

9. A device as in claim 1, which further comprises a closure for the blowing element group, the closure including a pair of roller-shutters, the blowing element group being enclosable by the roller-shutter pair, the roller-shutters being arranged parallel to each other and defining internally a free space between the two roller-shutters; and wherein the closure further includes a pair of rollers on which the roller-shutters are wound for opening the roller-shutters.

* * * * *